US005460392A

United States Patent [19]

Hansen

[11] Patent Number: 5,460,392

[45] Date of Patent: Oct. 24, 1995

[54] HEIGHT ADJUSTABLE UNIVERSAL CREEPER APPARATUS

[76] Inventor: Michael R. Hansen, 2302 15th Ave. West, Williston, N. Dak. 58801

[21] Appl. No.: 217,859

[22] Filed: Mar. 25, 1994

[51] Int. Cl.[6] ..... B25H 5/00

[52] U.S. Cl. ..... 280/32.6; 280/32.5

[58] Field of Search ..... 280/32.6, 32.5, 280/639, 640, 79.11, 62; 108/106, 144; 5/11

[56] References Cited

U.S. PATENT DOCUMENTS

| | | | |
|---|---|---|---|
| 1,603,212 | 10/1926 | Raymond | 280/32.6 |
| 2,701,168 | 2/1955 | Schemens | 280/32.5 X |
| 2,843,391 | 7/1958 | Pelletier | 280/32.6 |
| 4,863,178 | 9/1989 | Friesen | 280/32.6 |
| 4,895,380 | 1/1990 | Brooks et al. | 280/32.6 |
| 5,330,211 | 7/1994 | Nicholson | 280/32.6 |

*Primary Examiner*—Karin L. Tyson
*Assistant Examiner*—F. Zeender
*Attorney, Agent, or Firm*—David A. Lingbeck

[57] ABSTRACT

A height adjustable universal creeper comprises a moveable base, interchangeable posts, extension members, a cushioned platform mounted upon a frame which is mounted upon the extension members, and rungs attached to a long post and spaced apart along the length of the long post. A tray is slidably mounted beneath the platform near a terminal end of the frame and has a compartment to conveniently store tools, accessories, and the like. The height adjustable creeper is very versatile and can be easily adjusted not only above hard-to-reach work areas such as engine compartments of vehicles but also beneath the work areas such as beneath the vehicles.

4 Claims, 5 Drawing Sheets

HEIGHT ADJUSTABLE UNIVERSAL CREEPER APPARATUS

BACKGROUND OF THE INVENTION

The present invention relates generally to a height adjustable universal creeper apparatus upon which the user reclines to work above and below hard-to-reach work areas, in particular, and to work in hard-to-position work areas.

There are prior art related to benches or supports of all kinds upon which the user either reclines or leans against as he/she performs work. However, none of the prior art describes the present invention.

One known prior art is an ADJUSTABLE VARIABLE SLOPE ELEVATING CREEPER, U.S. Pat. No. 4,895,380, comprising a mobile horizontal frame, a platform for supporting a reclining person, lifter arms connected at their opposite ends to the ends of the platform and the frame, and a device for lifting one or both ends of the platform by a control operable by the reclining person. The elevating creeper allows the user to work from below the work area such as working under a vehicle or the like and is not designed to function above a work area, because the lifter arms prevent the user from positioning the platform over the work area.

Another known prior art is a MOVEABLE SUPPORT FRAME, U.S. Pat. No. 4,863,178, comprising a moveable support, an upright support post assembly, a cushioned person support having a stool configuration, back support configuration, a frontal support, a back support configuration, and a creeper position. The user of the support frame leans against the front support to perform work. The support frame doesn't facilitate the user to perform work in hard-to-reach work areas as does the present invention. Further, the support frame doesn't relieve the strain on the spine because the user of the support frame is in an upright position and typically bent over the work area, the precise reason for the present invention.

Another known prior art is an overhead bench comprising a base, a pair of upright posts members securely mounted upon and at the corners at one end of the base, two height adjustable sleeve-like members slidably mounted upon the posts, and a platform mounted upon the two sleeves. This overhead bench has two height adjustable means requiring at least two people to raise and lower the platform; whereas the present invention needs only one person to adjust the height of the apparatus. Further the two posts at the corners of the base prevents the apparatus from being moved sideways over the work area; whereas, the present invention can be moved sideways over the work area.

There are occasions when the prior art cannot be used in work areas where the user needs to perform work, because the prior art cannot be conveniently manipulated to get the user close to the work area. There is a definite need for a new height adjustable creeper apparatus which overcomes the problems of the prior art.

SUMMARY OF THE INVENTION

The present invention relates to a height adjustable universal creeper apparatus comprising a moveable base having two longitudinal members interconnected by two cross members interconnected by a central support member; a height adjustable means interchangeably mounted upon the base and having a plurality of rungs transversely attached along the length thereof for a user to climb to board a cushioned platform which is securely fastened upon a frame which is securely mounted upon the height adjustable means; and a tray slidably mounted under the platform at the front end of the frame and which can be conveniently slid under the platform out of the way when not being used.

It is an object of the present invention to provide a height adjustable creeper apparatus which has a platform that can be easily and effectively vertically adjusted to virtually any convenient height to facilitate the performance of the user.

Another object of the present invention is to provide a height adjustable creeper apparatus which has a platform upon which the user can recline to work either above or below the work area in the hard-to-reach work areas.

Further, another object of the present invention is to provide a height adjustable creeper apparatus which has a platform that can be positioned lengthwise or sideways above or below the work area giving the user greater access to reach the work area without the user having to bend and strain his/her back to perform his/her work.

Also, another object of the present invention is to provide a height adjustable creeper apparatus which allows the user to recline as he/she performs work in the hard-to-reach work areas to relieve back strain and eliminate fatigue of the user.

Yet, another object of the present invention is to provide a height adjustable creeper apparatus which allows the user to recline as he/she performs work in areas which are difficult for the user to position him/herself conveniently without strain to the body and effectively to perform the work such as over the dashes of vehicles and under the bodies of the vehicles.

Further objects and advantages of the present invention will become apparent as the description proceeds and when taken in conjunction with the accompanying drawing wherein:

DETAILED DESCRIPTION OF THE INVENTION

Figure 1:
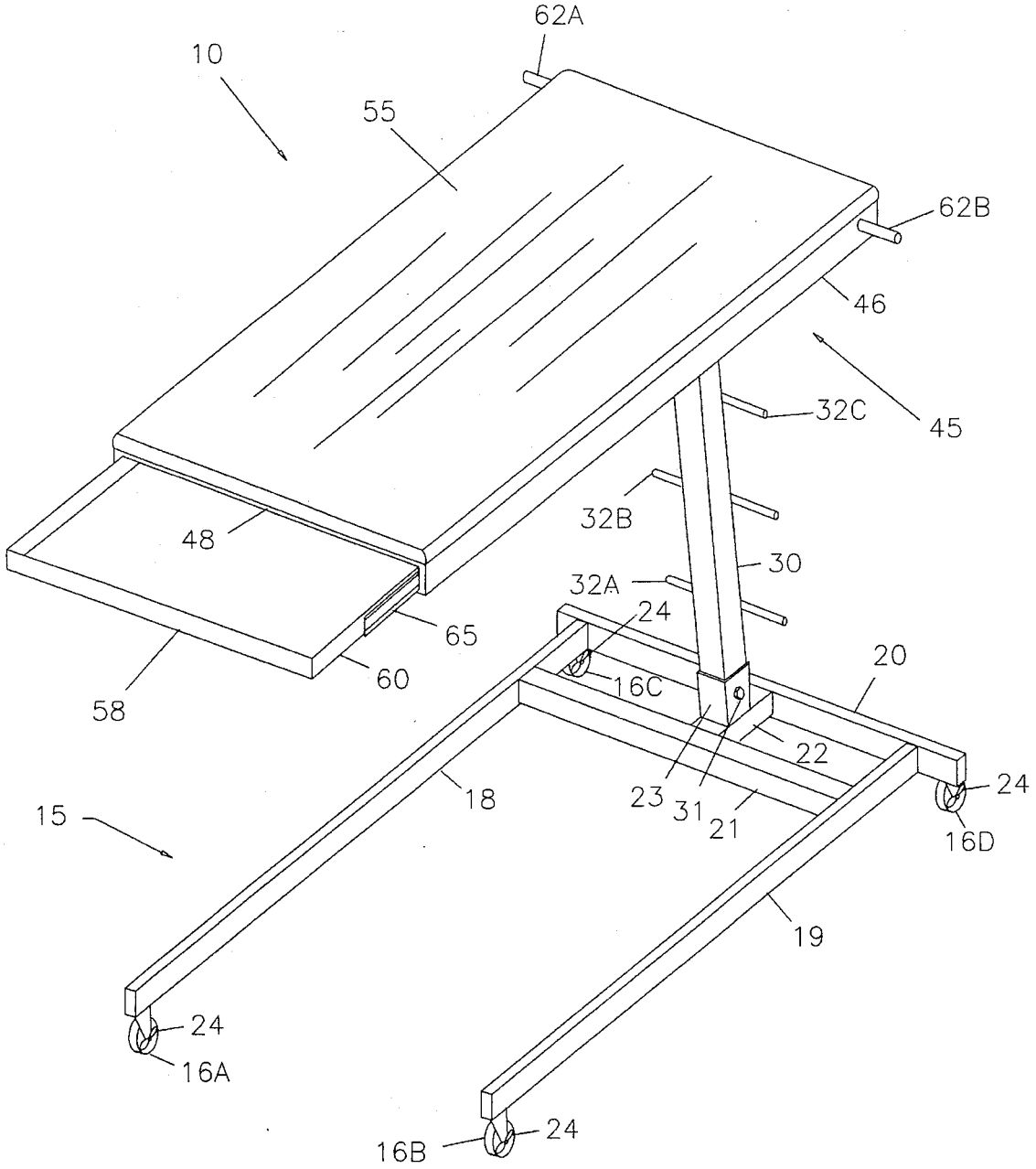
FIG. 1 is a front perspective view of the height adjustable creeper apparatus showing in particular the front end of the creeper apparatus with the tray extended out from the front end of the platform.

Referring to the drawing in FIGS. 1 through 5, the height adjustable creeper apparatus 10 comprises a wheeled base 15 having two elongate longitudinal members 18 and 19 generally horizontally arranged and interconnected by two cross members 20 and 21 which are interconnected by another cross member 22; a support member 23 vertically and fixedly mounted or welded upon the cross member 22 near the back end of the base and centralized relative to the two longitudinal members 18 and 19; a hollowed long post 30 preferably angled at about eighty-three and one-half degrees relative to the base 15 and detachably secured with a bolt 31 and received in the support member 23 and further having three rungs 32A, 32B, and 32C vertically spaced apart therealong and fixedly attached thereto; a hollowed short post 30' interchangeable with the long post 30 to position the creeper apparatus 10 in its lowest position; a long extension member 35 slidably extending through an open top end of the long post 30 to adjust the height of the creeper 10; a short extension member 35' slidably extending through an open top end of the short post 30' to adjust the height of the creeper 10 beneath a vehicle as such; a frame 45 having two elongate tubular side members 46 and 47 generally horizontally arranged and interconnected by two transverse members 48 and 49 and having a cap member 50 fixedly attached or welded to the transverse members 48 and 49 forming the back end of the frame 45 and dimensioned for engagingly receiving and detachably mounting upon either the top of the extension member 35 or the top of the short post 30'; a tray 58 slidably mounted in between the two side members 46 and 47 at the front end of the frame 45 opposite to where the cap member 50 is disposed; and a cushioned platform 55 securely mounted upon the frame 45 with a plurality of set screws (not shown).

As shown in FIGS. 1–5, the creeper apparatus 10 has a sturdy, moveable base 15 comprising two elongate longitudinal members 18 and 19 preferably made of metal and disposed generally parallel to each other and each having two lockable caster wheels 16A–16D fixedly mounted on the bottom, one near each end thereof with each wheel being lockable with a brake member comprising a bolt inserted through the wheel and fastened with a washer and wing nut 24 for adjustably engaging the wheel to brake the wheel so that the creeper apparatus can be immobilized as selected and desired by the user. Two cross members 20 and 21 preferably made of metal are fixedly attached or welded at their ends to the two longitudinal members 18 and 19. One of the cross members is fixedly attached at one of the ends of each longitudinal member and is interconnectively attached to the other cross member by a cross member 22 positioned parallel to the two longitudinal members 18 and 19. As shown in FIGS. 1–5, the support member 23 preferably made of metal and having an open top end is welded or fixedly attached upon the cross member 22 to receive and support the bottom end of either the long post 30 or the short post 30'. A bolt 31 is inserted through pairs of diametrically opposed holes in the support member 23, the long post 30, and the short post 30' to substantially secure either the long post 30 or the short post 30' in the support member 23 which has four walls formed and dimensioned to received the bottom end of either the long post 30 or the short post 30'.

Figure 2:
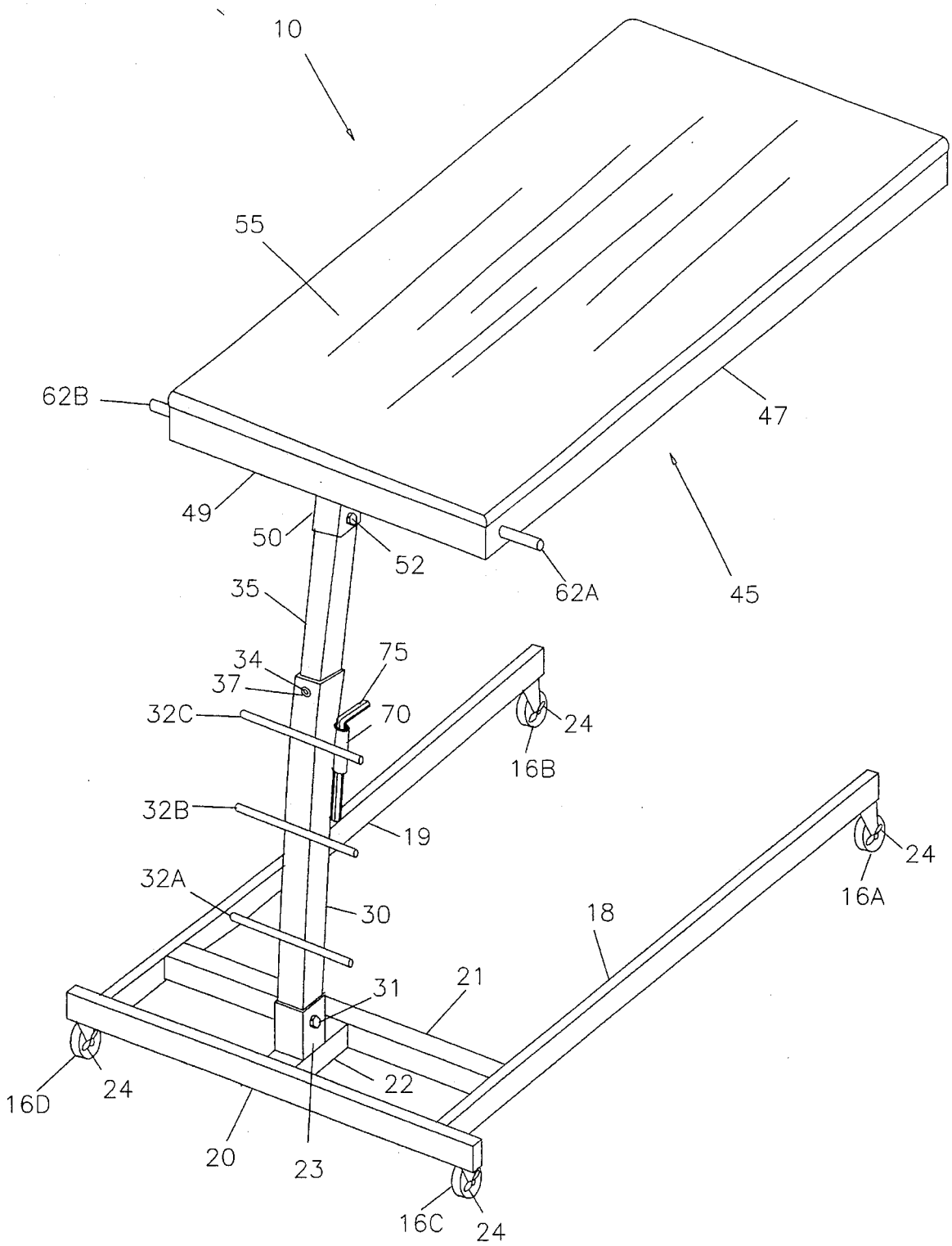
FIG. 2 is a rear perspective view of the height adjustable creeper apparatus showing in particular the back end of the creeper apparatus and the means to vertically adjust the platform and the means to board the platform.
Figure 3:
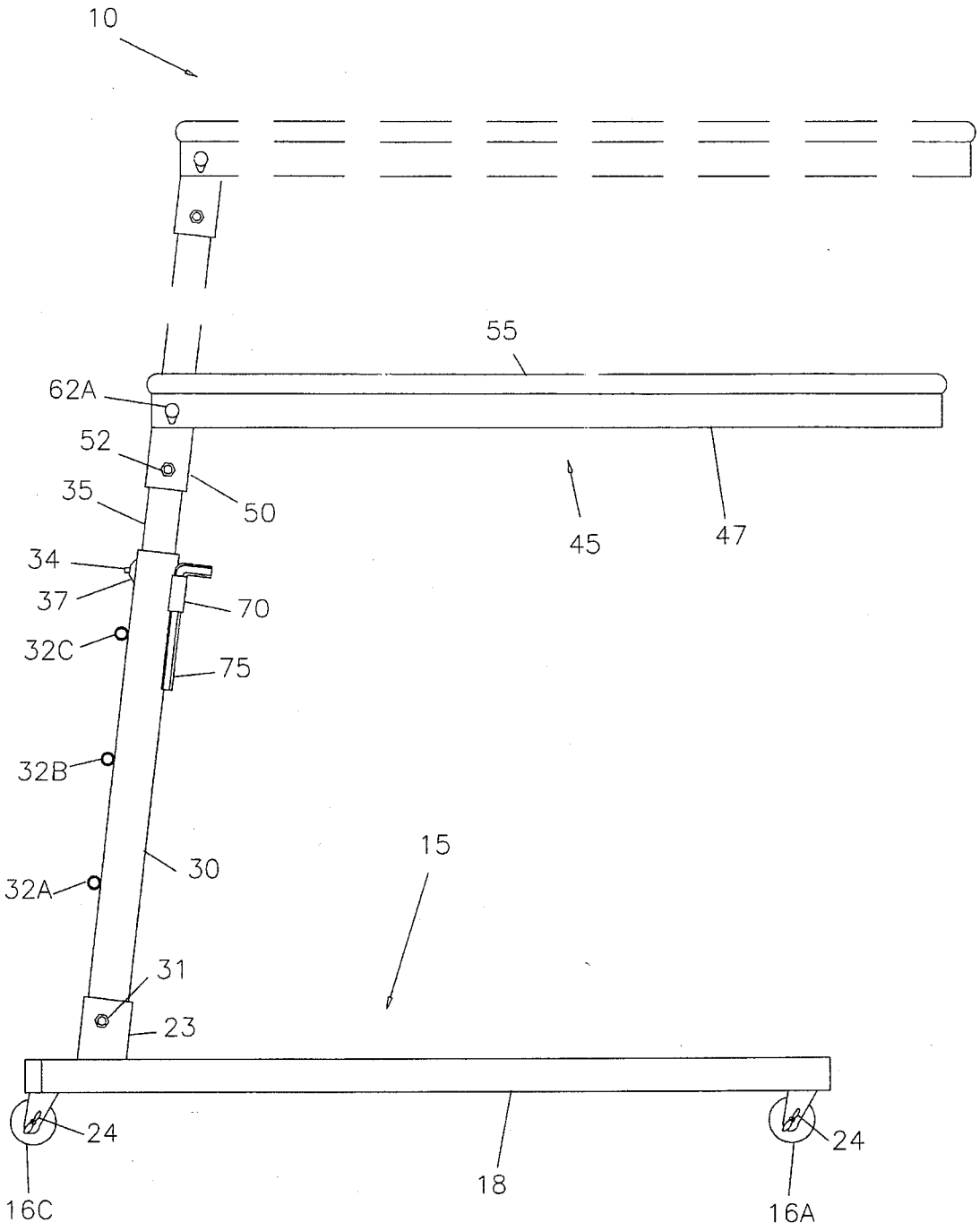
FIG. 3 is a side elevation view of the height adjustable creeper apparatus showing the height adjustability of the apparatus with the long post.

FIGS. 2 & 3 show the long extension member 35 slidably mounted through an open top of the hollowed long post 30 and generally having a portion extending upward from the long post 30 which has a hole 37 through the wall and near the top thereof. A threaded locking member 34 such as a headless bolt or the like is preferably used to lock the long extension member 35 at selected heights. The locking member 34 is threaded in the hole 37 through the wall of the long post 30 to engage the wall of the long extension member 35 to securely lock the long extension member 35 at a desired height as selected by the user.

Figure 4:
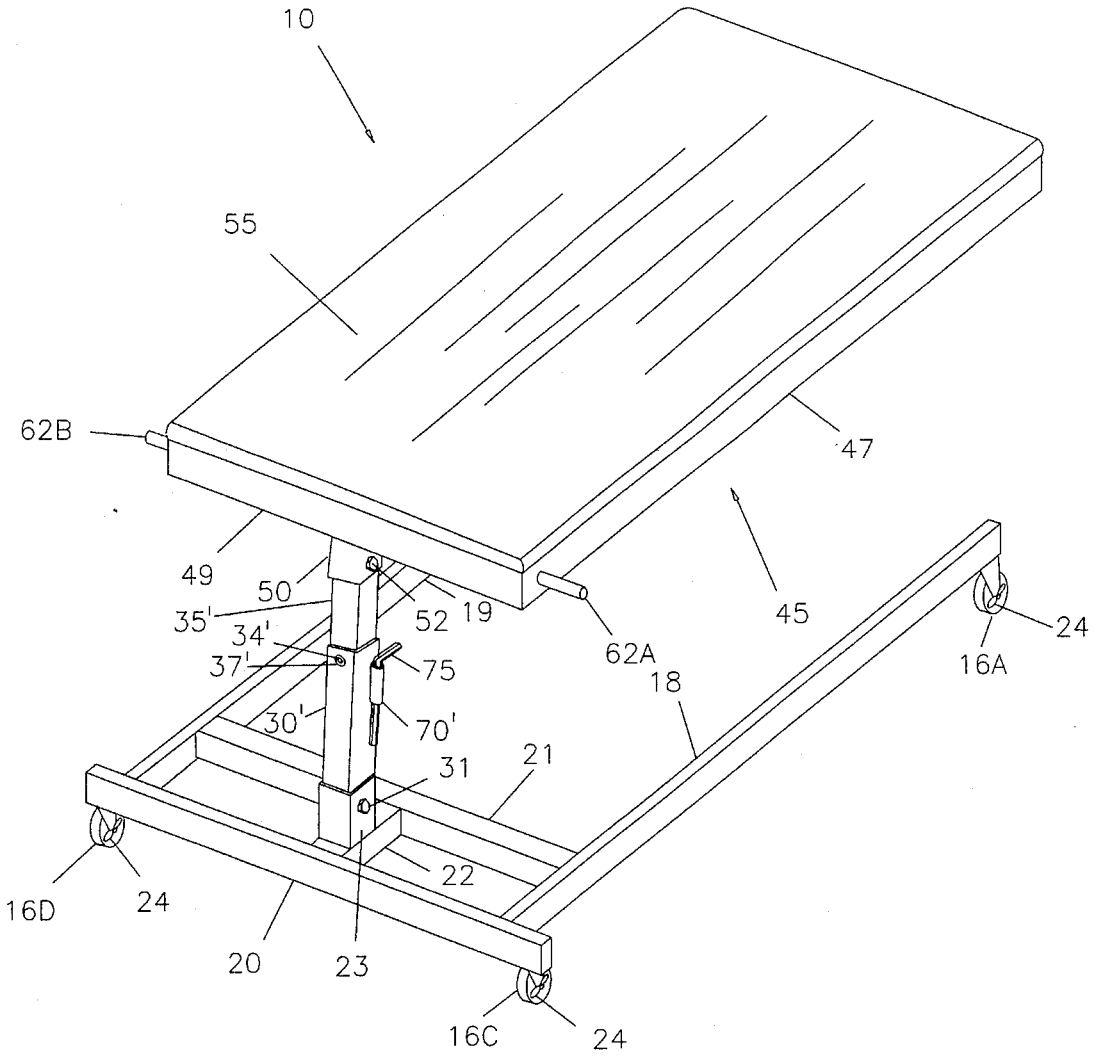
FIG. 4 is a rear perspective view of the height adjustable creeper apparatus in its lowest position for use under vehicles with the long post being replaced with the short post.
Figure 5:
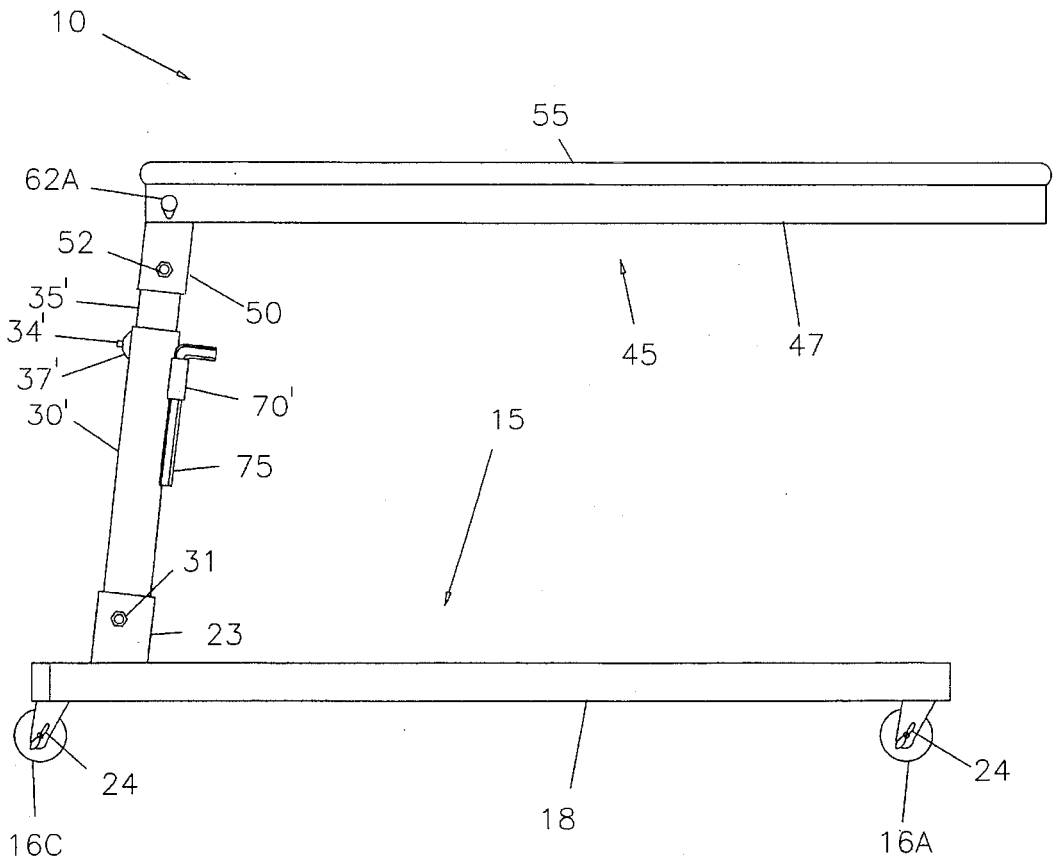
FIG. 5 is a side elevation view of the height adjustable creeper apparatus in its lowest position for use under vehicles as such with the short post replacing the long post.

FIGS. 4 & 5 show the short extension member 35' slidably mounted through an open top end of the hollowed short post 30' and generally having a portion extending upward from the short post 30' which has a hole through the wall and near the top thereof. A threaded locking means 34' such as a headless bolt or the like is preferably used to lock the short extension member 35' at selected heights. The locking means 34' is threaded in the hole 37' through the wall of the short post 30' to engage the wall of the short extension member 35' to securely lock the short extension member 35' at the desired height as selected by the user.

FIGS. 2 and 5 show three rungs 32A, 32B, and 32C preferably made of metal and having nonslip grips 33 securely attached to the upper surface thereof, the rungs being positioned parallel to one another and transversing the long post 30 for the user to climb to conveniently board the cushioned platform 55 which is preferably made of wood and covered with a vinyl material and having a foam-like material filled in between the vinyl material and the wood to provide a padded surface for the user to comfortably lie or recline upon.

The platform 55 is securely mounted upon the frame 45 preferably with bolts or screws and extends generally over and parallel the base 15. The frame 45 comprises two elongate side members 46 and 47 and two transverse members 48 and 49 fixedly interconnecting the two side members 46 and 47, all of which are preferably made of durable, lightweight metal. The two transverse members 48 and 49 are welded or the like at opposite ends of the two side members 46 and 47 forming a generally rectangular frame 45. The cap member 50 which is also preferably made of metal is welded or fixedly attached to and extending downwardly from a central portion of the transverse member 49 which forms the back end of the frame 45. The cap member 50 has an open bottom and is dimensioned to mount upon and receive the top end of either the long extension member 35 or the short extension member 35'. A bolt 52 is preferably inserted through diametrically opposed holes in the cap member 50 and near the top ends of the extension members 35 & 35' and is fastened with a nut to secure the frame 45 and platform 55 upon the extension members 35 or 35'.

As shown in FIG. 1, the tray 58, which is preferably made of metal, is slidably mounted in between the two side members 46 and 47 at the front end of the frame 45 beneath the platform 55 to store tools and the like for easy access by a user working from atop the creeper apparatus 10. The tray 58 comprises a bottom wall and four upstanding walls, one of which is the front end of the tray 58. Two elongate track members 60 are fixedly attached or riveted to either side of and along the side walls thereof. Two slide rail members 65 preferably made of metal are slidably mounted upon the two track members 60 to slide along the length of the two track members 60 and are further slidably mounted on two other track members (not shown) which are also fixedly attached with rivets or the like to and along a portion of the inside walls of the two side members of the frame 45. The two slide rail members 65 both have stop members (not shown) at the terminal ends thereof to prevent the two slide rail members 65 and the tray 58 from sliding off the frame 45. If the user doesn't use the tray 58, the user can slide the tray 58 under the platform 55 with a top portion of the front end of the tray 55 engaging the transverse member 48 in a closed position to effectively remove the tray 58 out of the way of the user, and if the user uses the tray 58, the user can slide the tray 58 out from under the platform 55 forward of the front end of the frame 45 to provide the user with easy access to the contents inside the tray 58, which could be tools, accessories, or the like.

FIG. 2 shows two handle members 62A and 62B securely mounted to either side of the side members 46 and 47 of the frame 45 at the back end of the frame 45 and having grips contoured to receive the fingers of the user. The handle members 62A and 62B each preferably have a rubberized cover thereover to provide the user with an effective gripping surface and also to soften the blow to a user accidentally running into or bumping into the handle members 62A and 62B as he/she passes by the creeper apparatus 10.

To use the creeper apparatus 10, the user preferably grasps the handle members 62A and 62B and moves the creeper apparatus 10 to the work area. The creeper apparatus 10 is uniquely constructed so that the user can use the creeper apparatus 10 either over the work area such as working over the engine compartment of a vehicle or under the work area such as working beneath a vehicle. To use the creeper apparatus 10 to work over the work area as such, the user should mount the long post 10 in the support member 23, slide the bolt through the diametrically opposed holes in the long post 30 and the support member 23, and slide the long extension member 35 through the top of the long post 30 with the platform 55 securely mounted upon the long extension member 35.

To adjust the creeper apparatus 10 to the height desired by the user, the user uses the tool 75 provided in the tool holder 70 which is fixedly attached or welded to the wall of the long post 30 to turn out and disengage the locking member 34 from the long extension member 35 and preferably uses his/her hands and arms to lift or lower the platform 55 relative to the base 15 and the long post 30. Once the platform 55 is adjusted to the desired height, the user turns in the locking member 34 to engage the wall of the long extension member 35 to secure and lock the long extension member 35 and the platform 55. The creeper apparatus 10 can be extended above and over the desired work area such as hard-to-reach areas of an engine compartment or the like or can be positioned for the user to recline upon while he/she works under the dashes or cars, pickups, trucks, and the like, which are difficult positions for the user to effectively and comfortably perform his/her work. To position the creeper apparatus 10 over or near the work area, the user should extend the front end of the platform 55 above and over or near the work area with the base 15 sliding under the work area. Before working from upon the creeper apparatus 10, the user can conveniently place tools or the like he/she plans to use in the tray 58.

To work from upon the creeper apparatus 10, the user climbs upon the rungs 32A, 32B, and 32C to safely and effectively board the platform 55 which may be a few feet above the ground. The long post 30 is inclined at an angle of approximately eighty-three and one-half degrees relative to the base 15 to allow the user to more easily climb upon the rungs to board the platform 55 since the long post 30 is disposed similar to a ladder leaning up against a structure or a house. The long post 30 is also inclined to extend the platform 55 farther horizontally relative to the base 15 so that the user can position the platform 55 over hard-to-reach work areas even when the base 15 cannot be moved closer to the work area. Once upon the platform 55, the user can recline or lie upon the platform 55 to safely work above the work area such as the engine compartment of a vehicle or the like. With the tools or the like in the tray 58 for easy access, the user can conveniently and effectively perform the work to be done. By reclining or lying upon the platform 55, the user is able to substantially reduce strain to his/her spine, which is a problem for many workers trying to bend over the engine compartment to work on the engine or the like for long periods of time. By using the creeper apparatus 10, the user can effectively work on hard-to-reach areas with essentially little or no strain to the back and to the legs, thus minimizing the risk of injury to the user, in particular, to the user's back. Further, by using the creeper apparatus 10, the user avoids having to stand on his/her legs for extended periods of time, thus reducing fatigue and improving work performance of the user. Once the creeper apparatus 10 is positioned for use, the user can lock the brake members on the wheels to secure the creeper apparatus and to prevent the creeper apparatus 10 from moving while the worker is upon the platform 55.

In addition to providing the user a means to work over the work area, the creeper apparatus 10 is very versatile and can be used by the user to work below the work area such as under a vehicle. The user can easily replace the long post 30 with the short post 30' by removing the bolts 31 from both the cap member 50 and the support member 23 so that the long post 30 can be removed from the support member 23 and the platform 55 can be removed from the long extension member 35. The short post 30' can then be mounted and bolted in the support member 23 with the short extension member 35' being slidably inserted through the top of the short post 30' and the cap member 50 can be mounted and bolted upon the short extension member 35' for the user to use the creeper apparatus 10 under the work area by moving the creeper apparatus 10 below the work area with the creeper apparatus 10 capable of being adjusted below the work area by threading the locking member 34' through the hole 37' of the short post 30' with the tool 75 provided in the tool holder 70' fixedly attached to the short post 30'. The user can easily climb and recline upon the platform 55 and move the creeper apparatus 10 in position by using his/her feet to push upon the ground to move the creeper apparatus 10.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A height adjustable universal creeper apparatus comprising:

a wheeled base having two elongate longitudinal members and at least one cross member which interconnects said two elongate longitudinal members;

a support member fixedly attached upon said base;

a height adjustable means detachably mounted upon said support member;

a frame having a cap member fixedly attached thereto, said cap member being detachably mounted upon said height adjustable means, said frame further having two side members spaced from one another and disposed generally parallel to said base;

a platform securely mounted upon said frame; and a tray slidably mounted beneath said platform and between and in alignment with said side members, said tray further having a compartment for storing tools and the like and being slidable from beneath said platform to expose said compartment.

2. A height adjustable universal creeper apparatus according to claim 1, wherein said height adjustable means comprises a long hollow post being detachably mounted upon said support member and having an open top end;

a long extension member slidably extending through said top end of said long hollow post for raising and lowering said platform as desired by the user; and a locking member threaded through a wall of said long hollow post for engaging and locking said extension member at minutely selected heights as desired by the user; and a ladder means comprising a plurality of rungs fixedly attached to and along the length of said long post for providing a means for a user to get upon said platform.

3. A height adjustable universal creeper apparatus according to claim 2, wherein said long post is slightly angled over above said base to allow the user to conveniently move upon said ladder means to get upon said platform.

4. A height adjustable universal creeper apparatus according to claim 2, wherein said height adjustable means comprises at least one hollow short post being interchangeable with said long hollow post and being detachably mounted upon said support member and further having an open top end;

a short extension member slidably extending through said top end of said short hollow port for raising and lowering said platform beneath a work area as desired by the user; and and said locking means threaded through a wall of said at least one short hollow post for engaging and locking said extension member at minutely selected heights as desired by the user.

* * * * *